US005825128A

United States Patent [19]

Betsui et al.

[11] Patent Number: 5,825,128

[45] Date of Patent: Oct. 20, 1998

[54] PLASMA DISPLAY PANEL WITH UNDULATING SEPARATOR WALLS

[75] Inventors: Keiichi Betsui; Shin'ya Fukuta; Tadayoshi Kosaka; Fumihiro Namiki; Osamu Toyoda; Shigeo Kasahara, all of Kawasaki, Japan

[73] Assignee: Fujitsu Limited, Kawasaki, Japan

[21] Appl. No.: 694,760

[22] Filed: Aug. 9, 1996

[30] Foreign Application Priority Data

Aug. 9, 1995 [JP] Japan ..... 7-202977

[51] Int. Cl.[6] ..... H01J 17/16; H01J 17/49

[52] U.S. Cl. ..... 313/582; 313/584; 313/586; 313/485; 315/169.4; 345/66

[58] Field of Search ..... 313/582, 583, 313/584, 585, 586, 587, 484, 485; 315/169.4; 349/32; 345/60, 66, 77; 365/116

[56] References Cited

U.S. PATENT DOCUMENTS

| | | | |
|---|---|---|---|
| 3,873,870 | 3/1975 | Fukushima et al. | 313/582 |
| 4,185,229 | 1/1980 | Yoshikawa et al. | 315/169.4 |
| 4,780,644 | 10/1988 | Sakai et al. | 313/582 |
| 5,107,182 | 4/1992 | Sano et al. | 315/169.4 |

FOREIGN PATENT DOCUMENTS

| | | | |
|---|---|---|---|
| 3-084831 | 4/1991 | Japan | H01J 11/02 |

*Primary Examiner*—Sandra L. O'Shea
*Assistant Examiner*—Michael Day
*Attorney, Agent, or Firm*—Staas & Halsey

[57] ABSTRACT

A plasma display panel has a matrix of plural first straight electrodes and plural straight second electrodes, respectively crossing each other, and a unit color element located at a crossing point of the first and second electrodes. A plurality of separator walls are spaced apart from each other and extend along the second electrodes, dividing a discharge space into a plurality of channels extending along respective, second electrodes. The separator walls undulate with a fixed periodicity so as to define alternating wide and narrow portions aligned along each channel and the respective first electrode. A fluorescent material is coated in each channel, the colors emitted from the fluorescent material being identical in each channel. A gas discharge takes place selectively at the wide portions in cooperation with the respective first and second electrodes. Optionally, connecting walls connect respective narrow portions of the adjacent separator walls, a height of the connecting wall being substantially lower than the height of the separator walls so as to allow the wide and narrow portions of each channel to be spatially continuous throughout a length of the channel.

23 Claims, 9 Drawing Sheets

PLASMA DISPLAY PANEL WITH UNDULATING SEPARATOR WALLS

BACKGROUND OF THE INVENTION

1. Field of the Invention

The present invention relates to a plasma display panel, referred to hereinafter as a PDP, of matrix type.

2. Description of the Related Art

A PDP is a thin display device that is excellent in the visual observation of a display thereon, is capable of high speed displaying, and easily allows to accomplish a comparatively large screen size.

Especially a PDP of surface discharge type in which display electrodes are arranged on a single substrate in pairs, for voltage application therebetween, is suitable for a color display using fluorescent materials.

FIG. 1 illustrates an exploded, perspective view of a PDP 80 of a prior art, where is shown the structure of a part which corresponds to a single picture element, i.e. a pixel, EG. FIG. 2 is a plane view schematically illustrating an arrangement of the prior art display electrodes.

In prior art PDP 80, each of pixels EG which compose the screen is formed of three sub-pixels EU of R. i.e. red, G, i.e. green & B, i.e. blue, aligned on a line. That is, this arrangement form of the three colors for the color display is a so-called in-line type.

PDP 80 is an AC type PDP of the surface discharge type for allowing the color display, and is composed of front and back glass substrates 11 and 21, a pair of first and second display electrodes Xn & Yn, a dielectric layer 17, a protection film 1, a back glass substrate 21, address electrodes A, separator walls 26, which may be referred to as a separator rib (or a barrier rib), fluorescent layers 28R, 28G & 28B, and a discharge gas enclosed in a discharge space 30 between the front and back glass substrates 11 & 21. Each of first and second display electrodes Xn & Yn is formed of a transparent electrode 41 of a relatively large width and a relatively narrow width metal electrode 42, which may be referred to as a bus electrode, for supplementing the electrical conductivity of the transparent electrode 41. First and second display electrodes Xn & Yn, in a pair, provide the above-mentioned line. Address electrode A extends along a row direction, orthogonal to the line direction, to cross the display electrodes Xn & Yn, and a voltage applied therebetween causes a discharge with respect to the second display electrode Yn in order to control wall charges upon dielectric layer 17 at the crossing point.

Separator walls 26 are straight and parallel when looked down thereat, and are arranged with an equal space measured in the extending direction of display electrodes Xn & Yn, that is, measured in the line direction of the display screen. Discharge space 30 is thus divided by the plural separator walls 26 so as to provide a channel therebetween for each unit display element EU, which is referred to hereinafter as a sub-pixel, divided in the line direction. The height of discharge space 30 is uniform throughout the display area.

Upon an application of a predetermined voltage to between the first and second display electrodes Xn & Yn in pair, an electric discharge takes place therebetween along the surface of dielectric layer 17 at a sub-pixel which has been addressed in the address period, so that fluorescent layer 28R, 28G or 28B in the addressed sub-pixel is excited to emit a light by an ultraviolet ray emitted from the discharge gas.

In the prior art structure shown in FIGS. 1 and 2, the distance d between a second display electrode Yn of one line (n) and the next first display electrode Xn+1 of the next line (n+1) had to be larger than a surface discharge gap g, which is a clearance between the paired display electrodes Xn and Yn, in order prevent an interference between the adjacent lines.

Therefore, there was a problem in that the area of non-luminant region, or portion, in the display screen was relatively large, resulting in a deterioration of the brightness of the whole screen.

There was also a problem in that the discharge in one line was apt to invade, along the row direction, the adjacent line, i.e. to interfere with the adjacent line, resulting in an obscure outline of the sub-pixel.

In addition, due to the sub-pixels EU for each of three colors being aligned on a single line, the width w of each sub-pixel EU measured along the line direction is one third of the pixel pitch ph. Therefore, it was difficult to further decrease the pixel pitch ph.

In order to solve the above problems, there was considered a mesh pattern of the separator walls as disclosed in Japanese Provisional Patent Publication Hei 3-84831. However, because discharge space 30 is divided into each sub-pixel which is divided not only in the line direction but also in the row direction, it was difficult to secure the reliability of the discharge control in driving the cells, and it was also difficult to properly coat the fluorescence layer and to clean up the inside of the divided cells.

SUMMARY OF THE INVENTION

It is an object of the present invention to achieve a sharp color display of long life without ruining the easiness of its fabrication and the driving of the cells.

It is another object of the present invention to enhance the brightness of the display screen by decreasing the area of the non-luminant portion in the display screen.

A plasma display panel, formed of a matrix of a plurality of first electrodes, which may be called display electrodes, and a plurality of second electrodes, which may be called address electrodes, where the first electrodes and the second electrodes are respectively straight and crossing each other, comprises a plurality of separator walls spaced apart from each other extending in parallel to the second electrodes, for dividing a discharge space into a plurality of channels extending in parallel to the second electrodes, wherein the separator walls are in a bank-shape snaking regularly, when looked at from above, said separator walls having alternative wide and narrow portions positioned so that the wide portions and the narrow portions are aligned and alternate along each channel and its associated first electrode, a fluorescent material is coated in each channel, wherein the colors emitted from the fluorescent materials are identical in each channel; and a gas discharge takes place at the wide portion in cooperation with the first and second electrodes.

The plasma display panel may be either a simple matrix type where the discharge takes place between the first and second electrodes, or a surface discharge type having three electrodes, where the discharge for lighting a unit cell is generated between a pair of two adjacent first electrodes, and the second electrode is to address a cell to be lit by forming a wall charge on the cell on the first electrode.

In the above-described configuration, the three unit color elements are located as to the respective wide portions so as to constitute a pixel of three unit color elements in a triangular relationship.

The plasma display panel may further comprise a connecting wall for connecting, at the narrow portion, the adjacent separator walls, where a height of the connecting wall is substantially lower than the height of the separator walls so as to allow the adjacent and alternating wide and narrow portions to be spatially continuous through each channel.

The above-mentioned features and advantages of the present invention together with other objects and advantages, which will become apparent, will be more fully described hereinafter, with references being made to the accompanying drawings which form a part hereof and wherein like numerals refer to like parts throughout.

A BRIEF DESCRIPTION OF THE DRAWINGS

FIG. 1 schematically illustrates a decomposition perspective view of a prior art PDP having straight separator walls;

FIG. 2 is a plan view to schematically illustrate an electrode configuration of FIG. 1 prior art;

FIG. 3 schematically illustrates a decomposition perspective view of a representative portion of a PDP as a first preferred embodiment of the present invention;

Figure 8A:
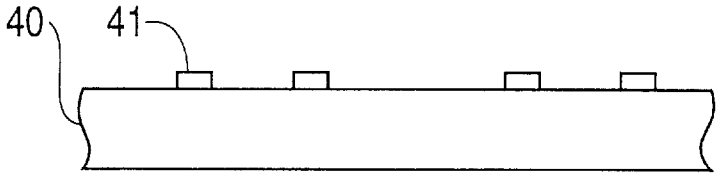
FIG. 8A is a cross-sectional view to schematically illustrate the step where a resist pattern is formed on a glass paste layer in fabricating the first preferred embodiment of the present invention.
Figure 8B:
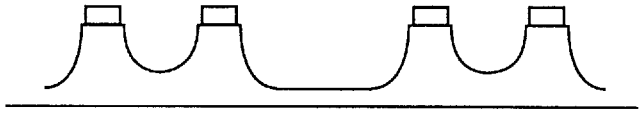
FIG. 8B is a cross-sectional view to schematically illustrate the step where sand-blasting is performed after the step shown in FIG. 8A.
Figure 8C:
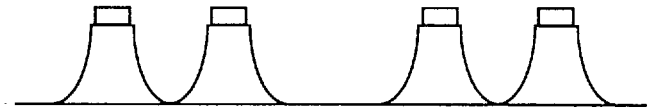
FIG. 8C is a cross-sectional view to schematically illustrate the step where sand-blasting is further performed after the step shown in FIG. 8B.
Figure 8D:
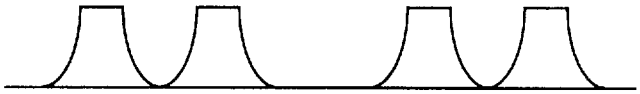
FIG. 8D is a cross-sectional view to schematically illustrate the step where the resist pattern is removed after the step shown in FIG. 8C.
Figure 8E:
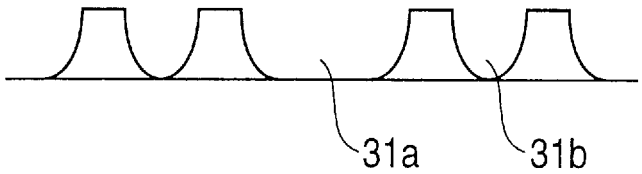
FIG. 8E is a cross-sectional view to schematically illustrate the step where a heating process is performed after the step shown in FIG. 8D.
Figure 8E:
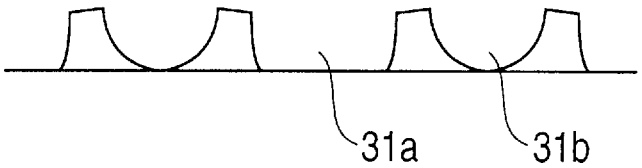
Figure 9A:
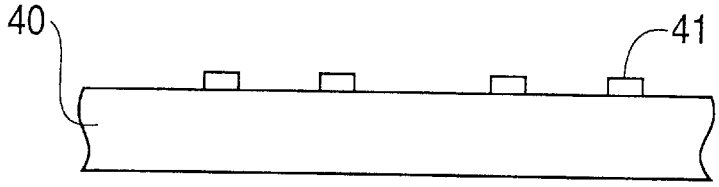
Figure 9B:
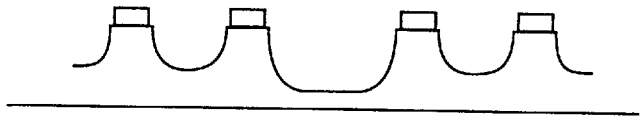
Figure 9C:
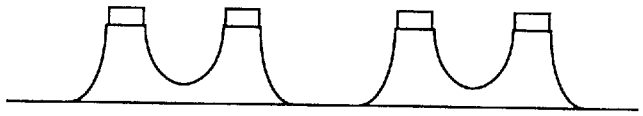
Figure 9D:
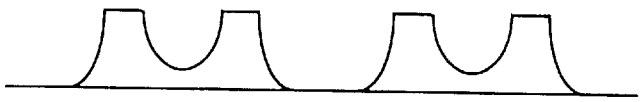
Figure 9E:
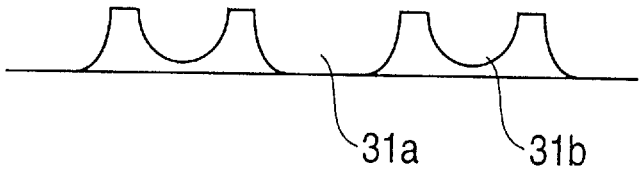

FIG. 8E' is a cross-sectional view to schematically illustrate the case where the separator walls are deformed after a heating process is performed;

FIG. 9A is a cross-sectional view to schematically illustrate the step where a resist pattern is formed on a glass paste layer in fabricating the third preferred embodiment of the present invention;

FIG. 9B is a cross-sectional views to schematically illustrate the step where sand-blasting is performed after the step shown in FIG. 9A;

FIG. 9C is a cross-sectional view to schematically illustrate the step where sand-blasting is further performed after the step shown in FIG. 9B;

FIG. 9D is a cross-sectional view to schematically illustrate the step where the resist pattern is removed after the step shown in FIG. 9C; and FIG. 9E is a cross-sectional view to schematically illustrate the step where heating process is performed after the step shown in FIG. 9D.

DETAILED DESCRIPTION OF THE PREFERRED EMBODIMENTS

A first preferred embodiment of the present invention is hereinafter described referring to FIG. 3 which schematically illustrates an exploded perspective view of a representative portion of a PDP to FIGS. 4A and 4B which show a planar view of the matrix structure and to FIGS. 5A and 5B which show a planar view of the layout relationship of the separator walls and the electrodes.

Figure 1:
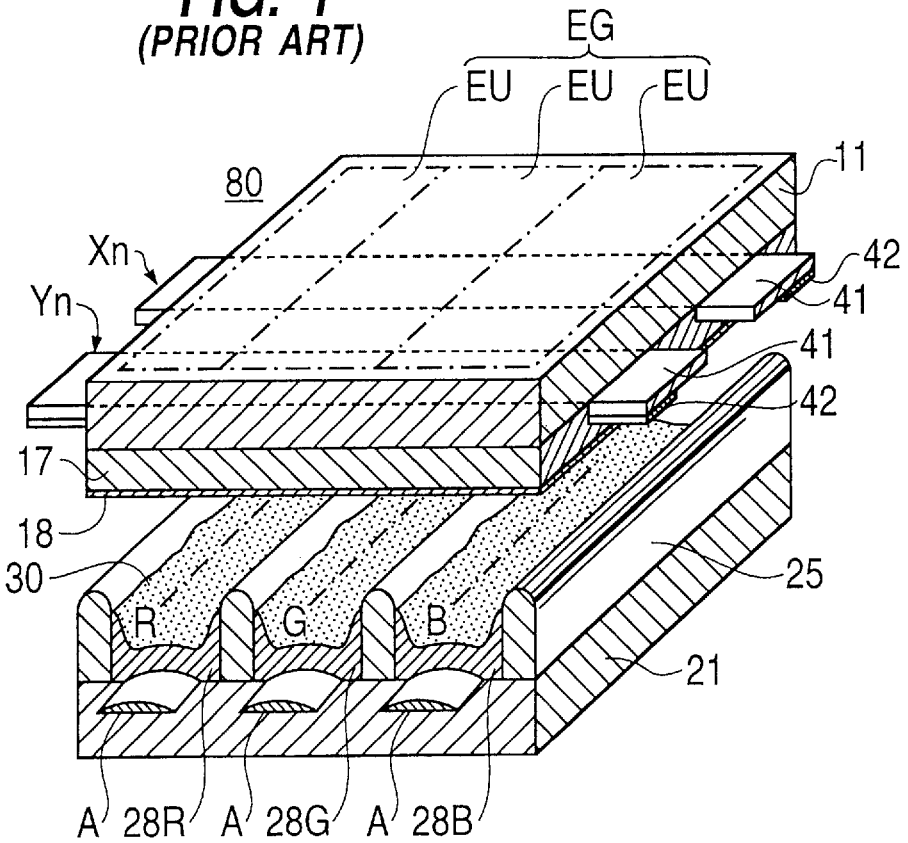
FIG. 1 (PRIOR ART)
Figure 2:
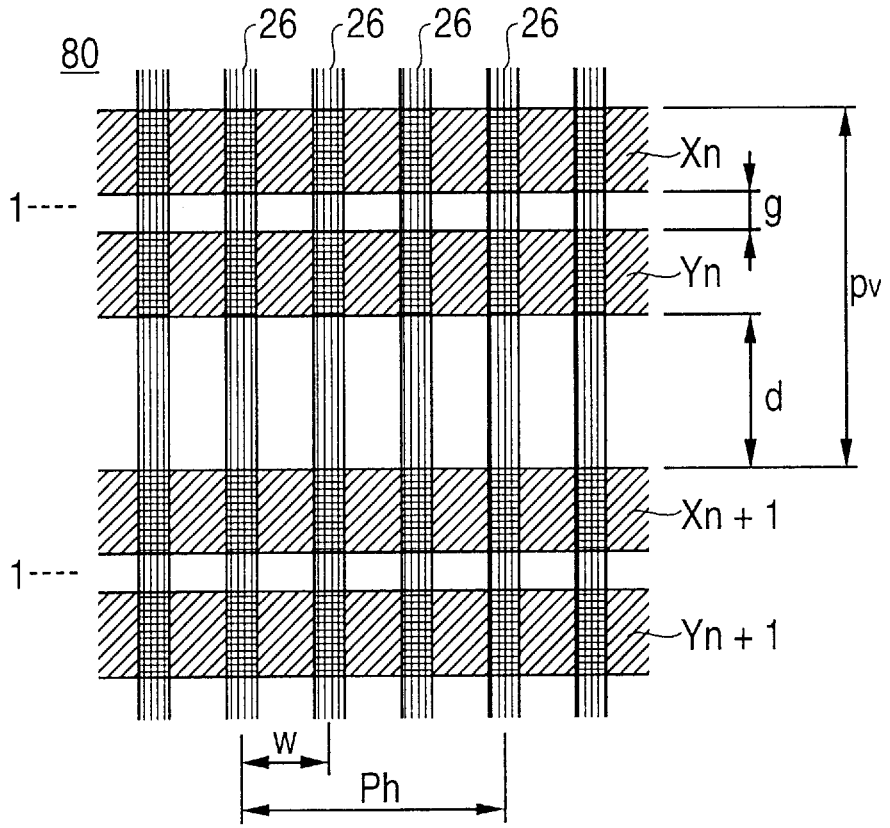
FIG. 2 (PRIOR ART)

Similar to prior art PDP 80 shown in FIG. 1, PDP 1 of the present invention is a surface discharge, AC drive type PDP having a three-electrode structure, where the first and second display electrodes Xn & Yn and an address electrode A define a unit display element EU, i.e. a sub-pixel, of the display matrix. That is, there are provided a plurality of display electrodes Xn & Yn, dielectric layer 17 and protection film 18 on front glass substrate 11, and a plurality of address electrodes A, a plurality of separator walls 29 and plural sets of fluorescent layers 28R, 28G, & 28B.

PDP 1 has two structural features. The first feature resides in that, in a planar view perpendicular to the substrate and protection film 1, the shape of the separator walls 29 for dividing discharge space 30 into spaced rows is that of banks snaking regularly—i.e., a zig-zag, or undulating, wall structure of a constant, or fixed, periodicity. The second feature resides in that display electrodes Xn & Yn are alternately arranged while being, separated by a predetermined equal clearance g comprising a surface discharge gap.

Hereinafter are explained these features more in detail. As shown in FIG. 4A, separator walls 29, typically approximately 100 $\mu$m high and 50 $\mu$m wide, are arranged such that the separator walls, or ribs, 29 are snaking, or undulating, as seen in the planar, view with a constant period and a constant amplitude so that the width of channels between the adjacent separator walls 29 becomes smaller than a predetermined value periodically along the direction of each row r, so as to provide a channel between the adjacent two separator walls. Consequently, the alternating wide and narrow portions are aligned along the channel direction and along the line direction.

The predetermined value of the width is a threshold value at which discharges thereon are inhibited and is determined by other discharge conditions, such as the gas-pressure, in addition to the width, etc. It has been widely known that an electrical discharge in a cylinder having a discharge gas therein, i.e. a positive column, is such that the discharging voltage between two electrodes separated in the axial direction of the positive column at a certain gas pressure becomes higher when the cylinder diameter is relatively smaller compared to the case where the cylinder diameter is relatively larger, resulting from the difference of the respective mean free paths of the electrons at the certain gas pressure.

It can be further explained that the electric field generated by the voltage applied to and thus between the adjacent display electrodes Xn & Yn at each wide portion 31*a* can normally generate the surface discharge is conventional; however, at each narrow portion 31*b*, the electric field is absorbed by the bulky separator walls which are too near to the portion of the gap g to generate the discharge;

accordingly, the electric field for the surface discharge cannot be adequate to cause the discharge. That is, the width of the narrow portion is chosen such that no surface discharge is generated; however, the width of the wide portion is chosen such that the same voltages applied across the electrodes an produce the surface discharge therebetween.

In fabricating separator walls 29, it is a preferable method that a uniform layer of the material of the separator wall, such as a paste of low melting point glass, is formed upon the glass substrate, a resist pattern is provided thereon by a photo lithography technique, and the separator walls are formed by means of sand-blasting. This fabrication method will be described later in detail together with that of the third preferred embodiment.

Channel portions 31*a* & 31*b*, i.e. the row space r, between adjacent separator walls 29 extends consecutively over all the lines 1 of the display screen because each separator wall 29 is spaced apart from another adjacent separator wall 29 by a respective channel therebetween. Therefore, the fluorescent material can be coated uniformly in the channel by the use of conventional screen printing method.

The fluorescent color of each channel r is identical, throughout the length of the channel. In PDP 1, the respective fluorescent materials for the three colors is coated in the corresponding channels r, in the order of fluorescent layers, for example, 28G, for G (Green) 28B for B (Blue) and 28R for R (Red).

As described above, in the channels r, the surface discharge does not take place at a portion 31*b* narrow width, measured in the direction of line 1, but takes place at a portion 31*a* of a wide, or large, width so as to effectively contribute to the light emission. Therefore, when two adjacent lines 1 are observed, two lines having respective sub-pixels EU are altered in every two line. In other words, sub-pixels EU queue up along zig-zag Paths respectively in both the rows direction and the lines direction.

Thus, in PDP 1, a single pixel EG is composed of three directly adjacent sub-pixels R, G & B. That is, the three colors are arranged of a triangular configuration, i.e. in a delta form.

Figure 5A:
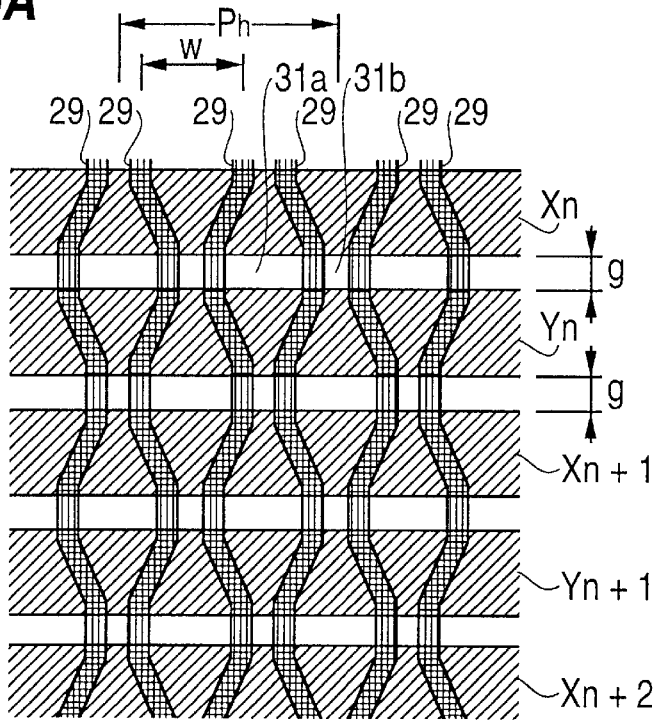
FIGS. 5A and 5B are planar views to schematically illustrate the layout relation of the separator walls and the electrodes.
Figure 5B:
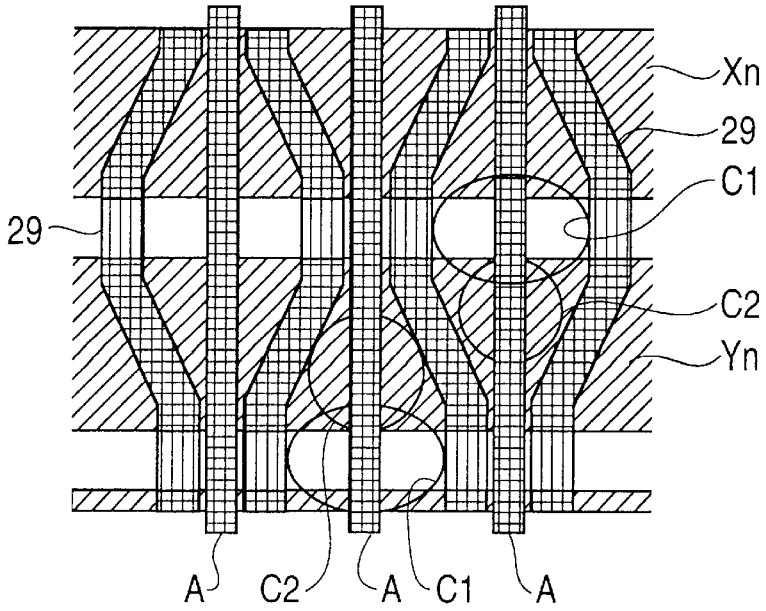

Display electrodes Xn & Yn are located such that the surface discharge gap therebetween extends to below the wide portion 31*a* of certain channels, as shown in FIG. 5A. However, as for a channel next thereto, the same surface discharge gap g extends to narrow portions 31*b*.

The quantity (i.e., number) of display electrodes is double the line quantity (i.e., number) plus 1, and is actually several hundreds in total, where the line quantity is almost doubled that of the FIG. 1 prior art straight wall configuration.

The PDP driving function, or operation, is hereinafter described. An address discharge cell C2 is defined on second display electrode Yn in the vicinity of an intersection of a side of second display electrode Yn and an address electrode A, in the above-mentioned wide portion 31*a* of each channel, as shown in FIG. 5B.

In a certain channel r there is also defined surface discharge cell C1, at a gap g at a first side of the second display electrode Yn, resultant from the above-described address discharge cell C1. In the adjacent channel there is defined another surface discharge cell C1, in the same way and at the second side, opposite from the first side, of the same second display electrode Yn.

Figure 3:
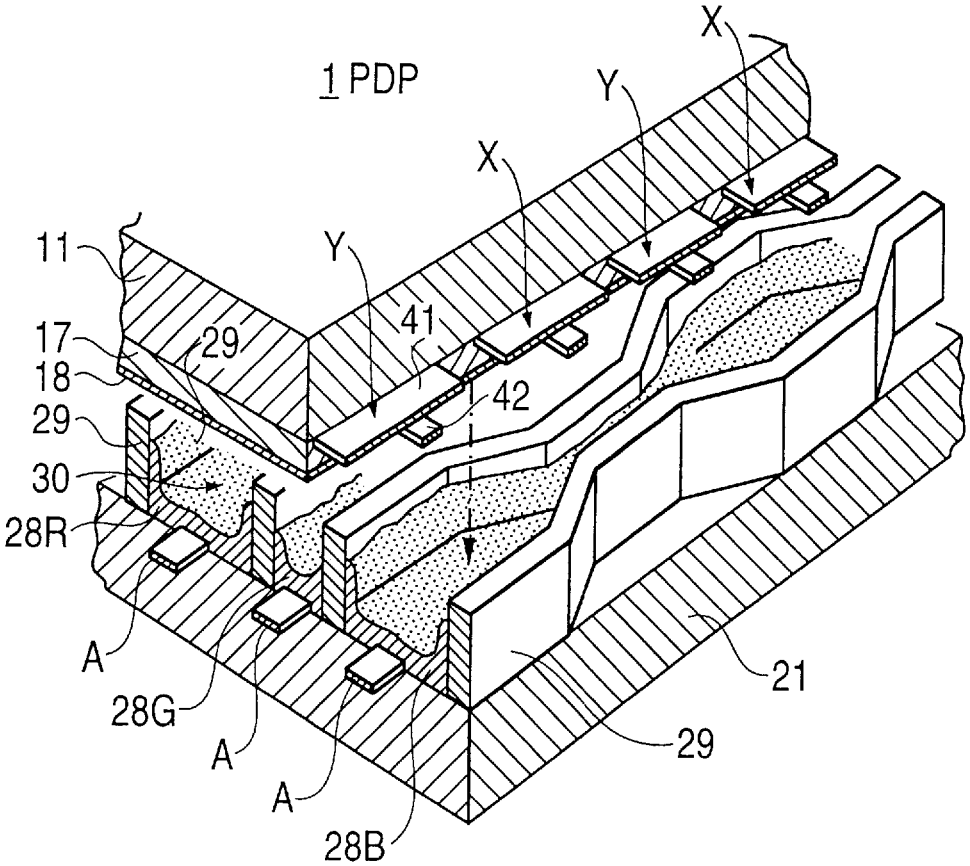
Figure 4A:
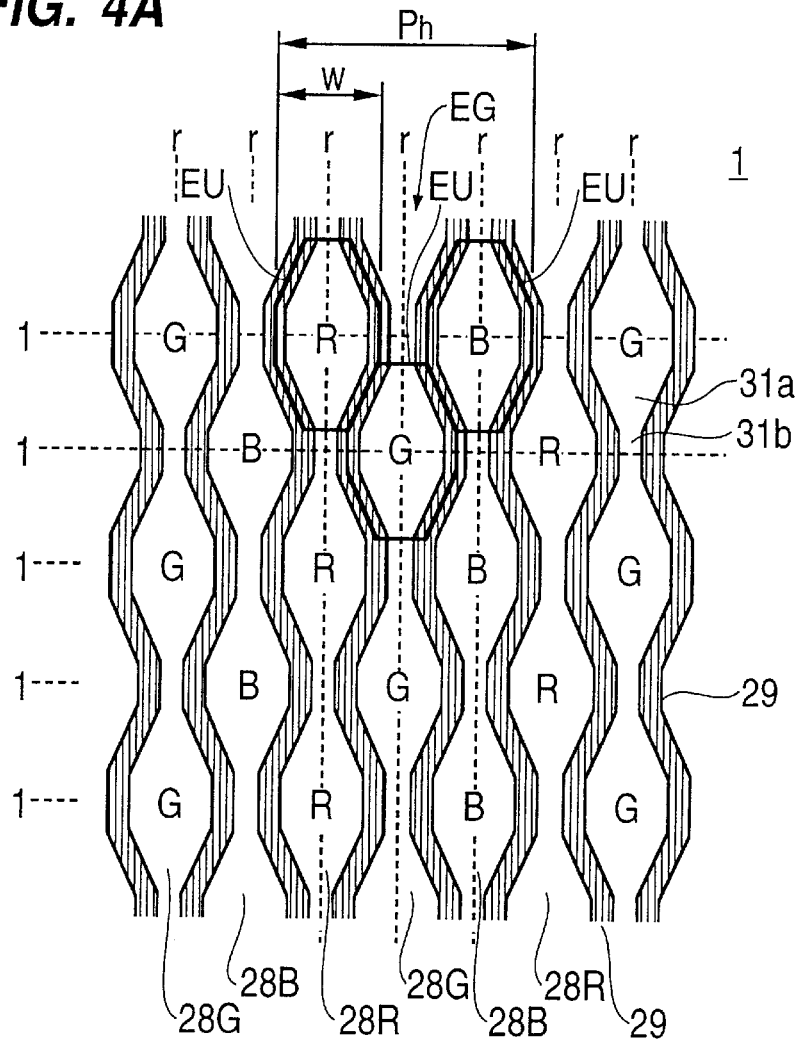
FIGS. 4A and 4B are planar views to schematically illustrate the matrix structure constituted of separator walls of the first preferred embodiment.
Figure 4B:
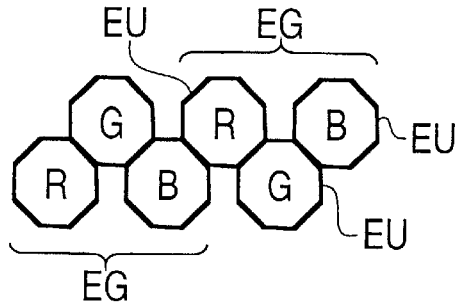

Each of the display electrodes Xn & Yn includes a bus electrode 42, for decreasing Its electrical resistance, laminated on the central zone of the transparent electrode 41 as shown in FIG. 3, because the surface discharge thus takes place at both of the opposite sides of each of the display electrodes Xn & Yn.

In operating the PDP 1, the display period of a single screen is divided into an address period and a sustain period, as is conventional.

In the address period, wall charges are selectively generated on cell C2 of a specific sub-pixel EU to be lit in accordance with the data of the display by the sequential screen scanning of the lines where the second display electrode Y functions as a scanning electrode, and by a selective voltage application on the address electrode A.

Next, in the subsequent sustain period, sustain pulses are alternately applied to, and thus between, all the first display electrodes X and all the second display electrodes Y, so that the previously addressed sub-pixel, i.e. the sub-pixel to be lit, is kept discharging and thus lighting. As described already, no discharge takes place at the narrow portions 31*b* of the channel r.

Owing to no discharge occurring at narrow portions 31*b*, no interference of the surface discharge is caused between adjacent sub-pixels EU in the channel direction.

Hereinafter is described the advantage of the triangular sub-pixel configuration. In the case where the sub-pixel pitch ph in the line direction is the same as that of the prior art in-line configuration, that is 390 $\mu$m, the width w, 160 $\mu$m, of sub-pixel EU measured in the line direction is larger than one third of pixel width ph, compared with the in-line configuration where the sub-pixel width w, 130 $\mu$m is one third of pixel pitch ph. Moreover, the line quantity is doubled by deleting the idle gap d between the second electrode Yn and the next first electrode Xn+1, as described earlier. In other words, the discharge space in each sub-pixel is larger while the pixel pitch is smaller compared with the prior art in-line configuration. Thus, the triangular arrangement is more advantageous in accomplishing a high resolution as well as high brightness of the display than the prior art in-line arrangement.

The application of the present inventions is not limited to only a full color display composed of three elementary colors as described above, but instead can also be applied to a so-called multi-color display.

The second preferred embodiment of the present invention is hereinafter described with reference to FIG. 6, including two elementary colors.

Figure 6:
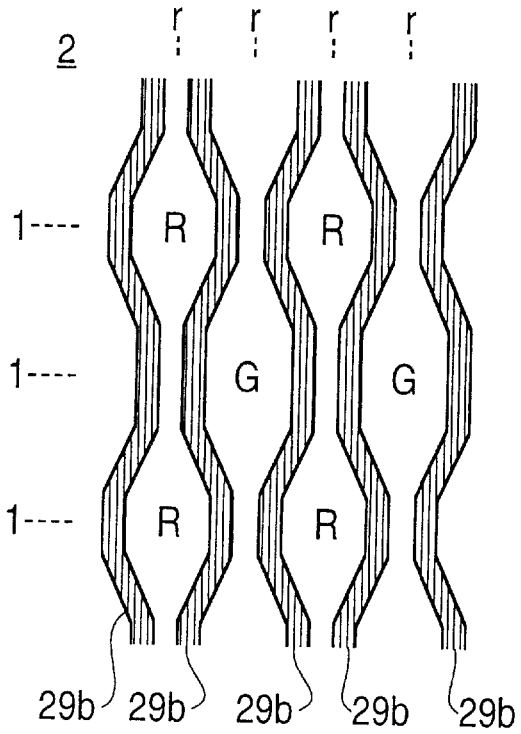
FIG. 6 is a planar view to schematically illustrate the second preferred embodiment having two primary color elements.

As seen in the planar view of FIG. 6, the snaking, or undulating, state of separator walls 29*b* is arranged such that the respective lengths, along the channel direction, of the sub-pixels of the two elementary colors are different from each other. For example, the row-wise length is 170 $\mu$m for R sub-pixel, and 220 $\mu$m for G pixel, while the line-wise widths w of the wide portion are equal for the two kinds of the pixels R & G. The light emitting characteristics of the green fluorescent material is compensated by the thus increased sub-pixel area so that the color balance can be accomplished, while the same advantages as the first preferred embodiment are enjoyed.

A clear display having a sharp outline of each pixel EG can be achieved in the above preferred embodiments, owing to the narrow portions 31*b* at each border line, separating the adjacent sub-pixels in the channel direction.

Owing to the sub-pixels EU being not divided into individual sections, in other words, the discharge spaces are continuous throughout other sub-pixels in the same channel, the priming function for initiating the discharge is effective commonly in each channel, whereby the discharge certainly takes place in any cell; moreover, the printing of the fluorescent material layer can be uniform, and the exhausting process can be easy.

Figure 7A:
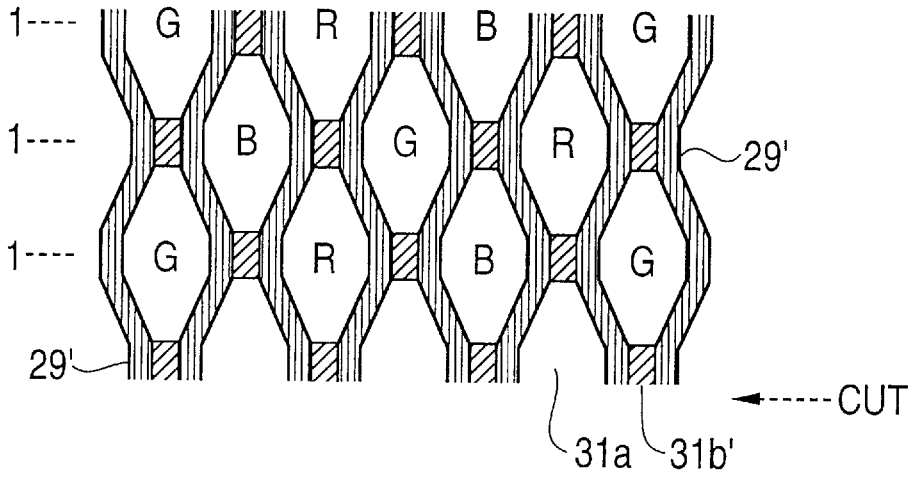
FIG. 7A is a planar view to schematically illustrate the separator walls of the third preferred embodiment.
Figure 7B:
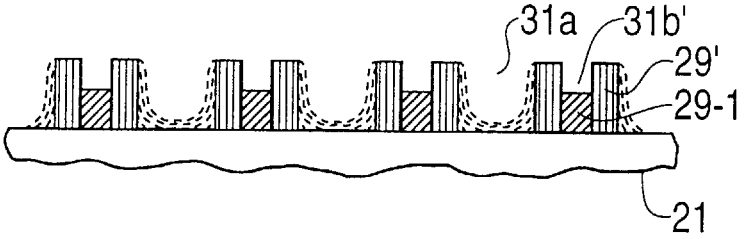
FIG. 7B is a cross-sectional view cut along the arrow of FIG. 7A.

A third preferred embodiment of the present invention is hereinafter described with reference to FIGS. 7A and 7B. The structure of the third preferred embodiment is featured in that the narrow portion 31*b* of the first preferred embodiment is provided with a connecting wall 29-1 for connecting the adjacent separator walls 29' forming the narrow portion 31*b*. Connecting, wall 29-1 is 10 to 60 μm high, preferably 30 μm high.

Hereinafter described are fabrication processes of the separator walls of the first and second preferred embodiments with reference to FIGS. 8A to 8E, and the separator walls plus the connecting wall of third preferred embodiments with reference to FIGS. 9A to 9E.

Step 1. Low melting point glass powder paste 40 is coated to a thickness of approximately 120 μm upon back glass substrate 21, and dried.

Step 2: Upon layer 40 there is formed a resist pattern 41 with a dry film, which has been well-known and is rubber-like so as to be resistant to a sand-blasting process, by the use of a conventional photolithographic techniques as shown in FIGS. 8A & 9A.

Step 3: Sand-blasting is performed onto the glass paste layer 40 and resist pattern 41 thereon so that the glass paste layer, having no resist pattern thereon, is removed while the glass paste layer, having resist pattern 41 thereon, is not removed. The glass paste layer at the wide portion 31*a* is removed faster than that at the narrow portion 31*b* as shown in FIGS. 8B & 9B. This is because the blasting air has a greater speed in the wide portion 31*a* than in the narrow portion 31*b*.

Step 4: The sand-blasting is further continued on until the glass removal reaches the glass substrate in the first preferred embodiment as shown in FIG. 8C. In the third preferred embodiment, the sand-blasting is terminated while the glass paste still remains at a target height, typically 30 μm, in the narrow portion 31*b* as shown in FIG. 9C. The removal speed of the glass layer is controlled by the blasting air speed and size of the grains of sand;

Step 5: The resist film 41 is removed by being immersed in an alkaline solution, as is well-known and as is shown in FIGS. 8D & 9D; and Step 6: The glass paste on the substrate is melted by being baked at a temperature sufficient to melt the glass paste, typically 540° C., as shown in FIGS. 8E & 9E.

During the baking process, the glass paste shrinks to about 100 μm high, whereby the separator walls may be somewhat swayed (i.e., distorted or curved) depending on the paste material, the shape of the snaking, the height and the width, as shown in FIG. 8E'.

In the third preferred embodiment having the connecting walls 29-1, the degree of the sway is much decreased.

After the separator walls are thus fabricated, fluorescent material of each color is coated into the respective wide portion 31*a* by the use of a conventional printing method. At this coating process, the fluorescent material may cross over the connecting wall 29-1 because the fluorescent material to be deposited on both sides of the connecting wall is of the same color. This fact allows an easy coating process compared with the prior art mesh structure. The fluorescent material crossing over the connection wall is rather preferable in providing higher brightness.

Though reflection type PDPs have been referred to in the above preferred embodiments wherein the fluorescent material is coated upon the inner surface of the back glass substrate 21, the present inventions can be applied to a penetration type PDP as well, wherein the fluorescent material is coated upon the inner surface of glass substrate 11 carrying the display electrodes thereon.

Though, in the above preferred embodiments, address electrodes A are on the substrate opposite to the display electrodes, the address electrodes A may be arranged on the glass substrate 11 having the display electrodes thereon.

Moreover, the present invention is applicable to PDPs of not only a three-electrode structure for the surface discharge but also to a so-called simple matrix structure, wherein display electrodes Xn & Yn intersect mutually.

There are two types of the simple matrix structure. The first type is such that first display electrodes Xn and second display electrodes Yn are opposed via discharge space 30. The second type is such that first display electrodes Xn and second display electrodes Yn are placed on a common substrate, and are opposed via an insulating layer.

Hereinafter described is the summary of the invention:

(1) In comparison with the prior art structure having the straight separator walls:

1.1, Brightness is improved, because the opening ratio, that is, the ratio of the light emitting area having the fluorescent material therein to the total area including the nonluminous separator walls, is improved by, for example, 27%, as well as because of the line quantity being doubled by utilizing the idle gap d. 1.2. Owing to the triangle arrangement of the sub-pixels, resolution in the line direction is improved, for example, from 390 μm to 260 μm.

1.3. Sub-pixels are sharp at the borders of each relative to the adjacent one in the channel direction, owing to no discharge interference being caused at the borders.

1.4. The clearance of the gap g between the display electrodes is increased, for example, from 40 μm to 90 μm, without substantially increasing the applied voltage thereto. This increased gap clearance is achieved owing to the increased pixel width w in the line direction and the spatial continuity through each channel, whereby the priming effect to certainly (i.e., reliably) initiate and to sustain the discharge is adequately secured.

1.5. Thus increased gap clearance decreases the electrical field concentration onto the insulator surface so that the deterioration of the MgO layer by the positive ion bombardment generated in the surface discharge is decreased, whereby a long life operation is accomplished.

(2) In comparison with the cited prior art mesh structure of Japanese Provisional Patent Publication Hei 1-848"1

2.1. The fabrication of the separator walls and the coating of the fluorescent material are easier.

2.2. The gas discharge can reliably take place owing to the priming effect through the channel space continuous to all the cells in each channel. In the prior art mesh structure, the priming does not always effect to the other spaces prevented by the mesh walls.

(3) In comparison of the third preferred embodiment structure of the present invention with the first preferred embodiment:

The sway of the separator walls is much more improved from the sway of the first preferred embodiment. Accordingly, the snaking walls is kept in the correct shape to provide bright and precise sub-pixels, the coating process of the fluorescent material is also kept easy; and the priming effect is still kept to allow reliable gas discharges. Furthermore, the yield in fabricating the panel is increased, and the mechanical strength of the panel after being sealed is improved as well.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not intended to limit the invention and accordingly, all suitable modifications are equivalents may be resorted to, falling within the scope of the invention.

What we claim is:

1. A plasma display panel, comprising:

a matrix of unit display elements arranged on a main surface of a substrate in rows in a first direction and lines in a second direction, generally perpendicular to the first direction;

a plurality of separator walls formed on the main surface of the substrate and extending along the first direction of said rows, adjacent separator walls being spaced apart in the second direction by corresponding channels defining respective discharge spaces, said separator walls having a zig-zag configuration such that each channel, between adjacent separator walls, varies periodically in width in the second direction between first and second widths respectively smaller than and at least as large as a width required for supporting discharges, the discharge spaces being of the second width;

fluorescent materials disposed in said channels, said fluorescent material in a given channel being of a common color; and a plurality of display electrodes, extending along said second direction in parallel relationship and spaced in the first direction, said display electrodes being arranged so that an electrical discharge is generated in a selected discharge space.

2. A plasma display panel according to claim 1, wherein three fluorescent materials, of three respective and different colors, are disposed in respective ones of three said channels, and wherein a first, a second and a third color of each of said unit display elements are arranged in a triangular configuration so as to form a pixel.

3. A plasma display panel according to claim 1, further comprising a connecting wall at each said narrow portion in each said channel interconnecting adjacent ones of said separator walls, a height of said connecting wall being substantially smaller than a height of said separator walls.

4. A plasma display panel according to claim 3, wherein said height of said connecting wall is greater than 10% and less than 60% of said height of said separator walls.

5. A plasma display panel according to claim 1, wherein said fluorescent materials are of first and second, different colors, a length of a portion of each said channel having said second width and said fluorescent material of said second color is longer in said first direction than a length of a portion of each said channel having said second width and said fluorescent material of said first color.

6. A plasma display panel according to claim 5, wherein said second color is green.

7. A plasma display panel, comprising:

a matrix of a plurality of first electrodes and a plurality of second electrodes, said first electrodes and said second electrodes being straight and crossing each other;

a plurality of separator walls, separated from each other and extending along a direction of said second electrodes, separating a discharge space so as to provide a plurality of channels therebetween, said separator walls being in a zig-zag shape, said second electrodes being disposed along said channel, a width of each channel periodically varying so as to provide alternating narrow and wide portions aligned along said first electrodes and along each of said channels, said narrow and wide portions of a common channel being spatially continuous through the common channel, electrical discharges being generated in selected said wide portions in cooperation with said first and second electrodes; and fluorescent materials disposed in said channels, a common florescent material emitting a respective color being disposed in each given channel.

8. A plasma display panel according to claim 7, wherein three fluorescent materials, of respective and different colors, are disposed in respective ones of three said channels, and wherein a first, a second and a third color of said unit display elements are arranged in a triangular configuration so as to form a pixel.

9. A plasma display panel according to claim 7, further comprising a connecting wall at each said narrow portion in each said channel interconnecting adjacent ones of said separator walls, a height of said connecting wall being substantially smaller than a height of said separator walls.

10. A plasma display panel according to claim 9, wherein said height of said connecting wall is greater than 10% and less than 60% of said separator wall.

11. A plasma display panel according to claim 7, wherein said fluorescent materials are of first and second, different colors, a length of a portion of each said channel having said second width and said fluorescent material of said second color is longer in said first direction than a length of a portion of each said channel having said second width and said fluorescent material of said first color.

12. A plasma display panel according to claim 11, wherein said second color is green.

13. A color plasma display panel of a surface discharge type, comprising:

a matrix of a plurality of first electrodes and a plurality of second electrodes, said first electrodes and said second electrodes being straight and extending in first and second directions, respectively crossing each other;

a plurality of spaced separator walls extending along a direction of said second electrodes and separating a discharge space into a plurality of channels, adjacent separator walls having a respective channel therebetween, said separator walls having a zig-zag configuration in the second direction, said second electrode being disposed along said channel, each channel periodically varying in width so as to provide alternating narrow and wide portions alternately aligned along each of said first electrodes and along each of said channels, said narrow and wide portions of a given channel being spatially continuous throughout a length of each channel, an electrical discharge being generated at a gap between two adjacent said first electrodes in said wide portion in cooperation with said first and second electrodes; and a fluorescent material disposed in each channel, colors emitted from said fluorescent materials in each given channel being identical.

14. A plasma display panel according to claim 13, wherein three fluorescent materials, of respective and different colors, are disposed in respective ones of three said channels, and wherein a first, a second and a third color of said unit display elements are arranged in a triangular configuration so as to form a pixel.

15. A plasma display panel according to claim 13, further comprising a connecting wall at each said narrow portion in each said channel interconnecting adjacent ones of said separator walls, a height of said connecting wall being substantially smaller than a height of said separator walls.

16. A plasma display panel according to claim 15, wherein said height of said connecting wall is greater than 10% and less than 60% of said separator wall.

17. A plasma display panel according to claim 13, wherein said fluorescent materials are of first and second, different colors, a length of a portion of each said channel having said second width and said fluorescent material of said second color is longer in said first direction than a length of a portion of each said channel having said second width and said fluorescent material of said first color.

18. A plasma display panel according to claim 17, wherein said second color is green.

19. A plasma display panel comprising:

a matrix of unit display elements, arranged on a main surface of a substrate in rows in a first direction and lines in a second direction, generally perpendicular to the first direction;

a plurality of separator walls formed on, and perpendicular to, the main surface of the substrate, extending along the first direction, said separator walls dividing a discharge space into a plurality of channels, adjacent separator walls being spaced in the second direction by said channels, each separator wall having a zig-zag configuration in a direction parallel to the main surface of the substrate, and each channel comprising a respective row of display elements, said separator walls being arranged such that a width of each channel varies periodically between a first width and a second width, each width in the second direction, said first width being less than a predetermined value and being smaller than said second width;

fluorescent materials disposed in each said channel, said fluorescent material in a given channel being of a common color; and a plurality of display electrodes, extending along said second direction and crossing said channels, said display electrodes being arranged so that an electrical discharge is generated at a portion of said channel having said second width and no electrical discharge is generated at a portion of said channel having said first width.

20. A plasma display panel according to claim 19, further comprising:

plural address electrodes extending in the first direction and aligned with respective, plural channels; and plural display electrodes, extending along said second direction and spaced in the first direction, arranged so as to be in crossing relationship with the address electrodes at the discharge cells and selectively operative for producing discharges at selected discharge cells.

21. A plasma display panel according to claim 20, further comprising fluorescent material disposed in each channel, the fluorescent material in a given channel being of a common type for producing a common color.

22. A plasma display panel, comprising:

a pair of substrates having respective exposed surfaces disposed in spaced, opposed relationship;

separator walls extending between, and substantially perpendicularly to, the opposed surfaces of the substrates and along the opposed surfaces in a first direction, adjacent separator walls being spaced in a second direction, perpendicular to the first direction, and defining a channel therebetween of alternating first and second portions of respective first and second width values, the first width value being less than a minimum width value necessary to support gaseous discharges within the channel and between the opposed surfaces, and the second width value being of at least the minimum width value, the second portions comprising discharge cells.

23. A plasma display panel according claim 22, further comprising:

transverse walls extending in the second direction between and interconnecting adjacent separator walls in the first portions thereof and having a reduced height relative to a height of the separator walls thereby maintaining a continuous opening throughout a length of each channel.

* * * * *